US007474145B2

(12) United States Patent
Negoro

(10) Patent No.: US 7,474,145 B2
(45) Date of Patent: Jan. 6, 2009

(54) CONSTANT CURRENT CIRCUIT

(75) Inventor: Takaaki Negoro, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 153 days.

(21) Appl. No.: 11/703,734

(22) Filed: Feb. 8, 2007

(65) Prior Publication Data

US 2007/0188216 A1 Aug. 16, 2007

(30) Foreign Application Priority Data

Feb. 9, 2006 (JP) ..... 2006-031785

(51) Int. Cl.
*G05F 1/10* (2006.01)
*G05F 3/02* (2006.01)

(52) U.S. Cl. ..... 327/543

(58) Field of Classification Search ..... 327/538, 327/540, 541, 543
See application file for complete search history.

(56) References Cited

U.S. PATENT DOCUMENTS 4,384,350 A * 5/1983 Lee et al. ..... 365/229
4,727,309 A * 2/1988 Vajdic et al. ..... 323/315
6,798,278 B2 * 9/2004 Ueda ..... 327/541

FOREIGN PATENT DOCUMENTS

| | | |
|---|---|---|
| JP | 56-108258 | 8/1981 |
| JP | 02-266407 | 10/1990 |
| JP | 03-136111 | 6/1991 |
| JP | 04-097405 | 3/1992 |
| JP | 05-191166 | 7/1993 |
| JP | 07-160347 | 6/1995 |
| JP | 09-199953 | 7/1997 |
| JP | 09-325826 | 12/1997 |
| JP | 11-194844 | 7/1999 |
| JP | 2002-236521 | 8/2002 |
| JP | 2004-192518 | 7/2004 |

* cited by examiner

*Primary Examiner*—Quan Tra
(74) *Attorney, Agent, or Firm*—Dickstein Shapiro LLP

(57) ABSTRACT

A constant current circuit includes first and second depression type MOS transistors having drains connected to a high electric potential side; and first, second, and third enhanced type MOS transistors having sources connected to a low electric potential side.

8 Claims, 4 Drawing Sheets

CONSTANT CURRENT CIRCUIT

BACKGROUND OF THE INVENTION

1. Field of the Invention

The present invention generally relates to constant current circuits having MOS (Metal Oxide Semiconductor) structures, and more specifically, to technique proper for stabilizing operation of a circuit.

2. Description of the Related Art

In an analog circuit using a MOS (Metal Oxide Semiconductor) transistor, in order to stabilize operation, a reference voltage and a constant current source are critical. However, in the MOS transistor used for making the constant current source, unevenness of a threshold value of voltage in a manufacturing process or change of the threshold value of voltage due to temperature occurs. For example, if the threshold value of voltage becomes high, the constant current becomes great. If the threshold value of voltage becomes low, the constant current becomes small.

As a related art constant current circuit which corresponds to unevenness of the threshold value in the manufacturing process of the MOS transistor, a circuit shown in FIG. 1 is discussed in Japanese Patent No. 3517343.

FIG. 1 is a circuit diagram showing a structural example of a related art constant current circuit using an MOS (Metal Oxide Semiconductor) transistor. In a circuit shown in FIG. 1(*a*), a depression type MOS transistor (D-type MOS transistor) 31 and a resistance 32 are used. In a circuit shown in FIG. 1(*b*), only the depression type MOS transistor (D-type MOS transistor) 31 is used.

In the circuit shown in FIG. 1(*b*), a gate, a source, and a substrate of the D-type MOS transistor 31 are connected to a ground electric potential VSS, and a drain is connected to a high electric potential VDD. A constant current is caused to flow between the source and drain of the D-type MOS transistor 31.

In the circuit shown in FIG. 1(*b*) and using only the D-type MOS transistor 31, an absolute value of the constant current or a temperature coefficient is drastically changed due to change of the threshold value of voltage of the D-type MOS transistor 31 generated in a manufacturing process of the D-type MOS transistor 31 such as thermal diffusion, gate oxidization, or ion implantation.

On the other hand, in the circuit shown in FIG. 1(*a*), the resistance 32 is provided between the gate and source of the D-type MOS transistor 31. IN other words, the source of the D-type MOS transistor 31, the substrate, and one end of the resistance 32 are connected. The gate of the D-type MOS transistor 31 and another end of the resistance 32 are connected to the VSS. The drain of the D-type MOS transistor 31 is connected to the VDD.

Under this structure, due to unevenness of the manufacturing process, for example, if the threshold value of voltage of the D-type MOS transistor 31 becomes high, the constant current flowing in the D-type MOS transistor 31 is increased.

However, due to the voltage drop generated by the electric current flowing through the resistance 32 provided between the gate and source of the D-type MOS transistor 31, the gate electric potential of the D-type MOS transistor 31 is changed in a direction negative (minus "−") against the source electric potential where the current is not constant. As a result of this, the constant current is stabilized.

On the other hand, if the threshold value of voltage of the D-type MOS transistor 31 becomes low, the constant current flowing in the D-type MOS transistor 31 is decreased. Since the voltage drop generated by the electric current flowing in the resistance 32 becomes small, the gate electric potential of the D-type MOS transistor 31 is changed in a direction positive (plus "+") with the source electric potential where the constant current easily flows. As a result of this, the constant current is stabilized.

Generally, in a case where the temperature rises or a case where the constant current becomes large together with the change of the threshold value of voltage of the D-type MOS transistor 31, it is possible to obtain a more stabilized constant current by using the resistance 32 where the resistance value becomes larger, such as a poly-silicon resistor or diffusion resistor.

In addition, a structural example of a voltage reference circuit using the constant current circuit shown in FIG. 1(*a*) is discussed in Japanese Patent No. 3517343. A structural example of a voltage reference circuit using the constant current circuit shown in FIG. 1(*b*) is discussed in Japanese Laid-Open Patent Application Publication No. 9-325826 and Japanese Examined Patent Application Publication No. 4-65546.

FIG. 2 is a circuit diagram showing a structural example of a related art voltage reference circuit using the MOS (Metal Oxide Semiconductor) transistor. More specifically, FIG. 2 shows a structure example of a voltage reference circuit using the constant current circuit shown in FIG. 1(*b*) and discussed in Japanese Laid-Open Patent Application Publication No. 9-325826 and Japanese Examined Patent Application Publication No. 4-65546.

In the voltage reference circuit shown in FIG. 2, a drain of a depression type (D-type) n-channel MOS transistor 45 is connected to an electric power source at a high electric potential side. A source and a bulk of an enhancement type (E-type) n-channel MOS transistor 47 is connected to an electric power source at a low electric potential side.

A bulk and a source of the D-type n-channel MOS transistor 45 are connected to a drain of the E-type n-channel MOS transistor 47 at a connection point 48. Gates are connected to each other at a connection point 46 and the connection point 48. This connection point 48 is a voltage reference output where the electric power at the low electric potential is a standard electric potential.

Generally, an enhancement type (E-type) MOS transistor is a surface channel type transistor and therefore unevenness of a threshold voltage cause by manufacturing processes is small.

On the other hand, a depression type (D-type) transistor is an embedded channel type transistor and therefore unevenness of the threshold voltage caused by manufacturing processes is large. Hence, unevenness of a saturation drain electric current caused by manufacturing processes is extremely great.

FIG. 3 is a circuit diagram showing a structural example of a constant current circuit using the voltage reference circuit shown in FIG. 2.

In the constant current circuit shown in FIG. 3, a source of a depression type MOS transistor, namely a D-type MOS transistor 51 (indicated as "DepTr1" in FIG. 3) whose drain is connected to an electric power source 56 at the high electric potential side, a drain of an enhancement type MOS transistor, namely a E-type MOS transistor 53 (indicated as "EnhTr1" in FIG. 3) whose source is connected to a low electric potential side (ground), and gates are connected so that the voltage reference circuit shown in FIG. 2 is formed and a standard voltage 57 is obtained.

In addition, the standard voltage 57 is connected to the gate of an E-type MOS transistor 55 (indicated as "EnhTr 3") and a saturation drain current of the E-type MOS transistor 55 (EnhTr 3) is output as a constant current value Iref.

In this case, a saturation drain current of a D-type MOS transistor 51 is a constant current source and the drain and the gate are common in the E-type MOS transistor 53. Therefore, the gate voltage is determined so as to be an upper part constant current value. Since the gate voltage is applied to the E-type MOS transistor 55 so that the E-type MOS transistor 55 operates, an electrical current value of the D-type MOS transistor is a current mirror.

In a constant current circuit having the D-type MOS transistor 51 (DepTr1), the E-type MOS transistor 53 (EnhTr1), and the E-type MOS transistor 55 (EnhTr 3), if manufacturing unevenness of the threshold voltage of the D-type MOS transistor 51 (DepTr1) is large, unevenness of values of the saturation drain electrical current flowing in the D-type MOS transistor 51 (DepTr1) becomes large and the saturation drain current (constant current value Iref) of the E-type MOS transistor 55 (EnhTr 3) is also drastically influenced.

In the D-type MOS transistor 51 (DepTr1), change of the threshold value voltage due to the temperature is changed. As a result of this, the standard voltage 57 made by threshold value difference, namely the difference of the threshold voltages of the D-type MOS transistor 51 (DepTr1) and the E-type MOS transistor 53 (EnhTr1), is unstable so that the entirety of the constant current circuit using this standard voltage 57 is unstable.

For example, Japanese Laid-Open Patent Application Publication No. 2-266407 discloses a technique for solving this problem. In this technique, the resistance is provided between the substrate and the source of the the E-type MOS transistor 55 (EnfTr 3) and trimming by laser rays is applied to this resistance, so that the electric current value is adjusted.

For example, Japanese Laid-Open Patent Application Publication No. 2004-192518 discloses a technique whereby a constant current generation circuit having small temperature dependency is realized by trimming the resistance.

However, in a case where trimming process is applied, a transistor having different size has to be prepared and a large area for making a bit for trimming easy is required. Therefore, correction cannot be made for the change of the temperature.

In addition, a stabilizing technique of the constant current circuit is discussed Japanese Patent No. 2599304, Japanese Laid-Open Patent Application Publication No. 4-97405, Japanese Patent No. 2800523, Japanese Laid-Open Patent Application Publication No. 2002-236521, Japanese Patent No. 3052818, and Japanese Laid-Open Patent Application Publication No. 7-160347.

Thus, it is a problem to be solved by the present invention that the change of the threshold value of voltage due to unevenness of manufacturing of the D-type MOS transistor 51 (DepTr1) and the change of the threshold value of voltage due to the temperature change are generated in the related art constant current circuit shown in FIG. 3 so that the constant current circuit shown in FIG. 3 is unstable.

SUMMARY OF THE INVENTION

Accordingly, embodiments of the present invention may provide a novel and useful constant current circuit solving one or more of the problems discussed above.

More specifically, the embodiments of the present invention may provide a constant current circuit wherein influence on a constant current output value due to unevenness in manufacturing of the D-type MOS transistor installed in the constant current circuit or temperature change is reduced.

One aspect of the present invention may be to provide a constant current circuit, including first and second depression type MOS transistors having drains connected to a high electric potential side; and first, second, and third enhanced type MOS transistors having sources connected to a low electric potential side; wherein a source and a drain of the first depression type MOS transistor are connected so that a first connection is formed, a gate of the first depression type MOS transistor and a gate of the first enhancement type MOS transistor are connected so that a second connection is formed; the second connection and the first connection are connected so that a third connection is formed; a source of the second depression type MOS transistor and a drain of the second E-type MOS transistor are connected via a resistance so that a fourth connection is formed; a gate of the second depression type MOS transistor and a gate of the second enhancement type MOS transistor are connected so that a fifth connection is formed; the fifth connection and the first connection are connected so that a sixth connection is formed; a gate of the third enhancement type MOS transistor is connected to the fourth connection between the drain of the second enhanced type MOS transistor and the resistance so that a seventh connection is formed; and a drain of the third enhancement type MOS transistor is an output end of the constant current circuit.

According to the above-mentioned constant current circuit, even if threshold values of the transistors are changed due to manufacturing unevenness so that amounts of electrical current flown in the transistors are changed, correction is made in a direction where an amount of change is absorbed by the resistance so that a constant value of the electrical current can be made.

Furthermore, it is possible to make a constant electrical current value not depending on a power supply voltage by using a poly-silicon resistor not depending on the power supply voltage for the resistance.

Other objects, features, and advantages of the present invention will be come more apparent from the following detailed description when read in conjunction with the accompanying drawings.

DETAILED DESCRIPTION OF THE PREFERRED EMBODIMENTS

A description is given below, with reference to the FIG. 4 and FIG. 5 of embodiments of the present invention.

Figure 1:
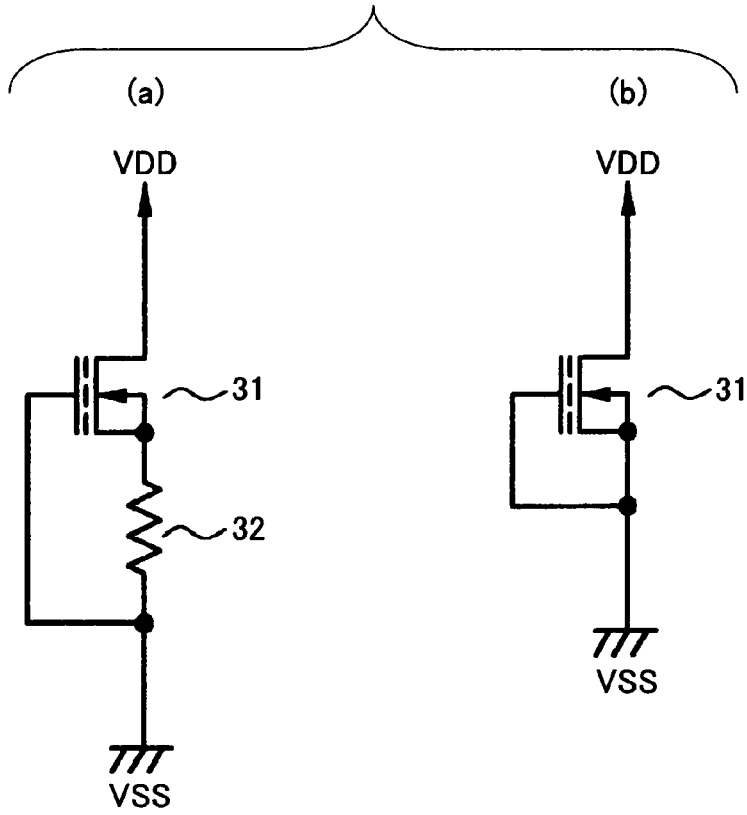
FIG. 1 is a circuit diagram showing a structural example of a related art constant current circuit using an MOS (Metal Oxide Semiconductor) transistor.
Figure 2:
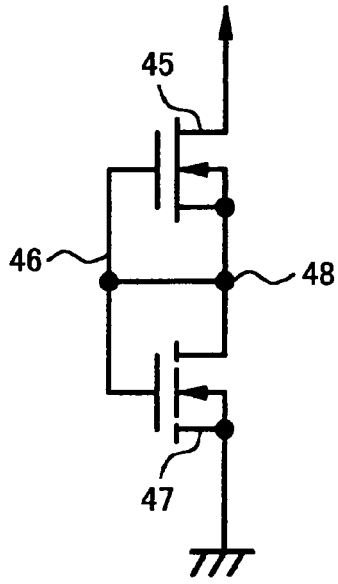
FIG. 2 is a circuit diagram showing a structural example of a related art voltage reference circuit using the MOS (Metal Oxide Semiconductor) transistor.
Figure 3:
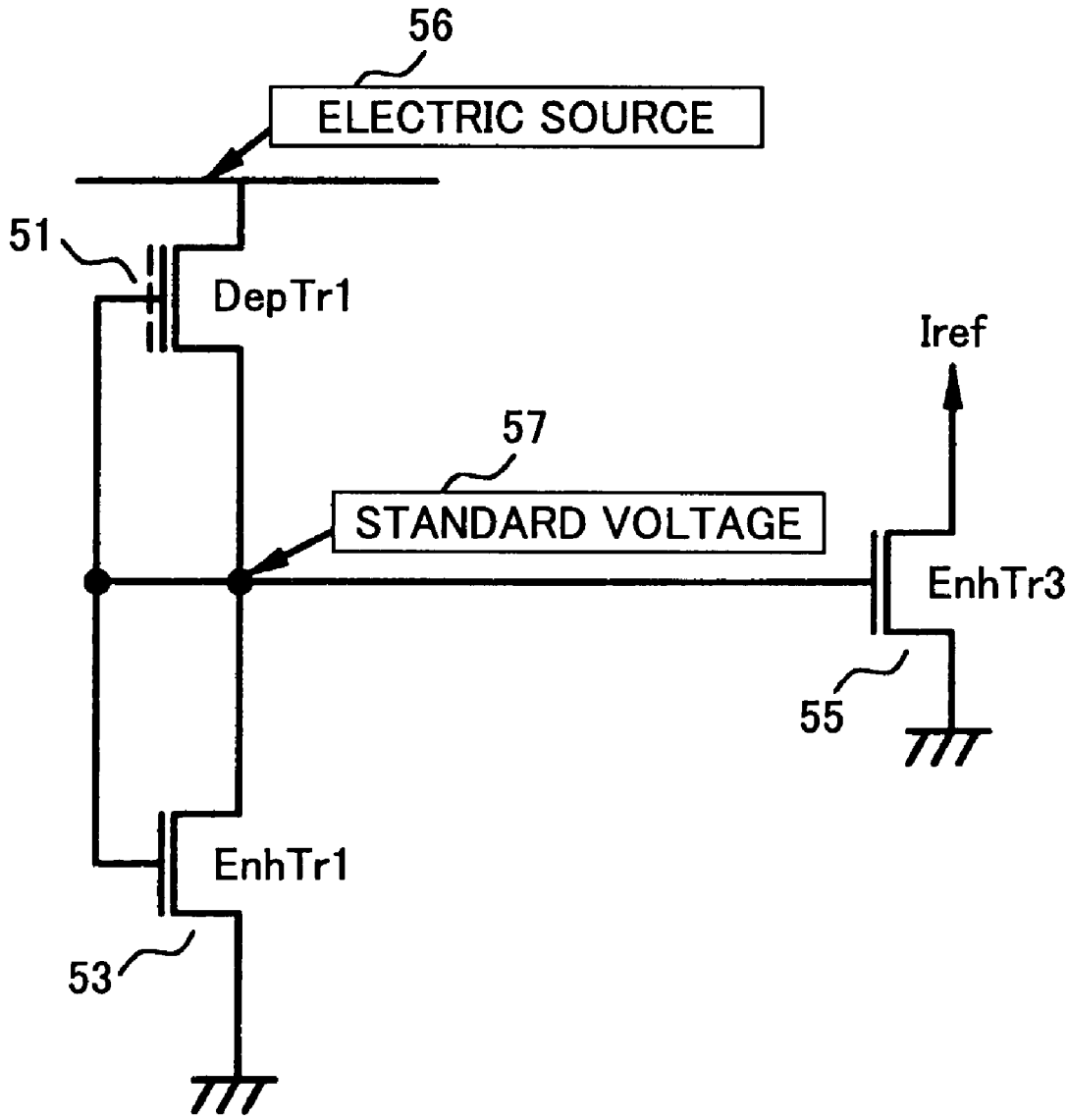
FIG. 3 is a circuit diagram showing a structural example of a constant current circuit using the voltage reference circuit shown in FIG. 2.
Figure 4:
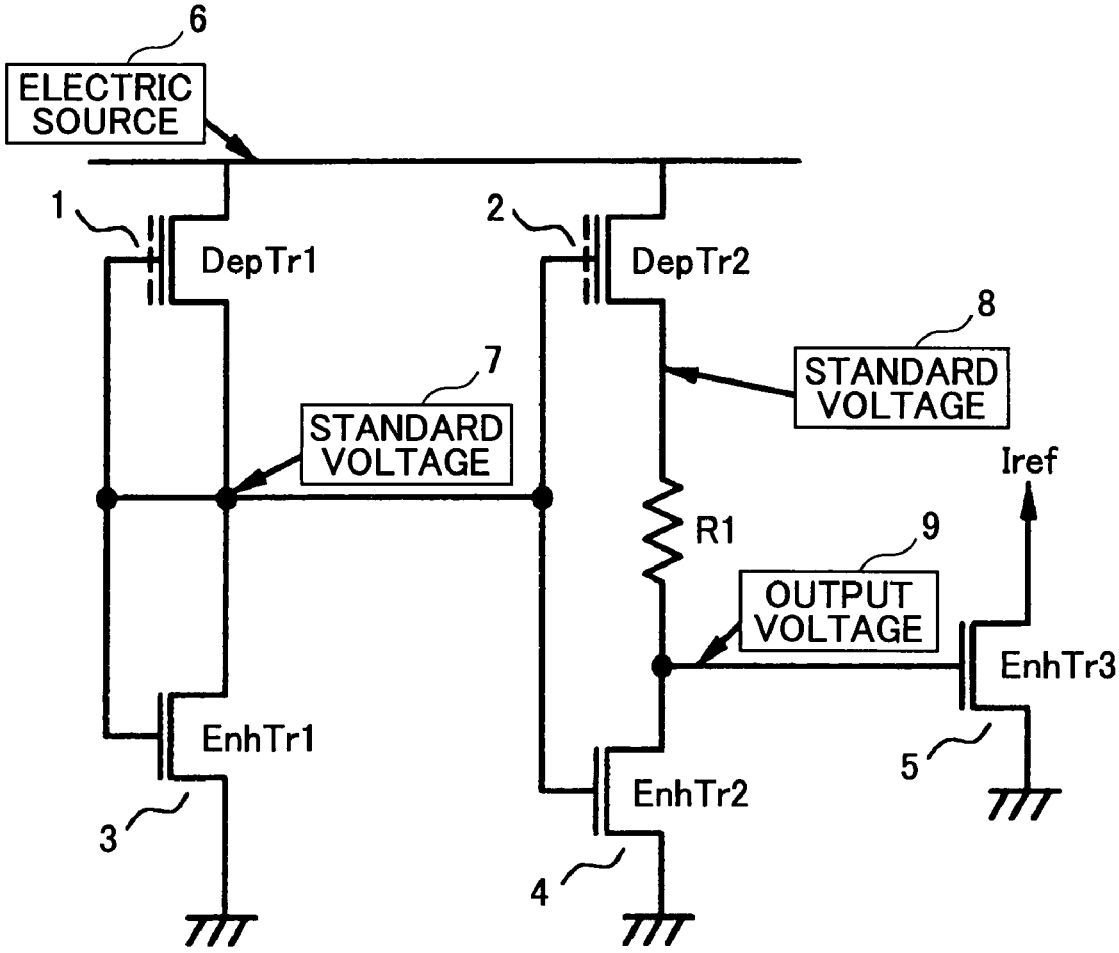
FIG. 4 is a circuit diagram showing a structural example of a constant current circuit of an embodiment of the present invention.
Figure 5:
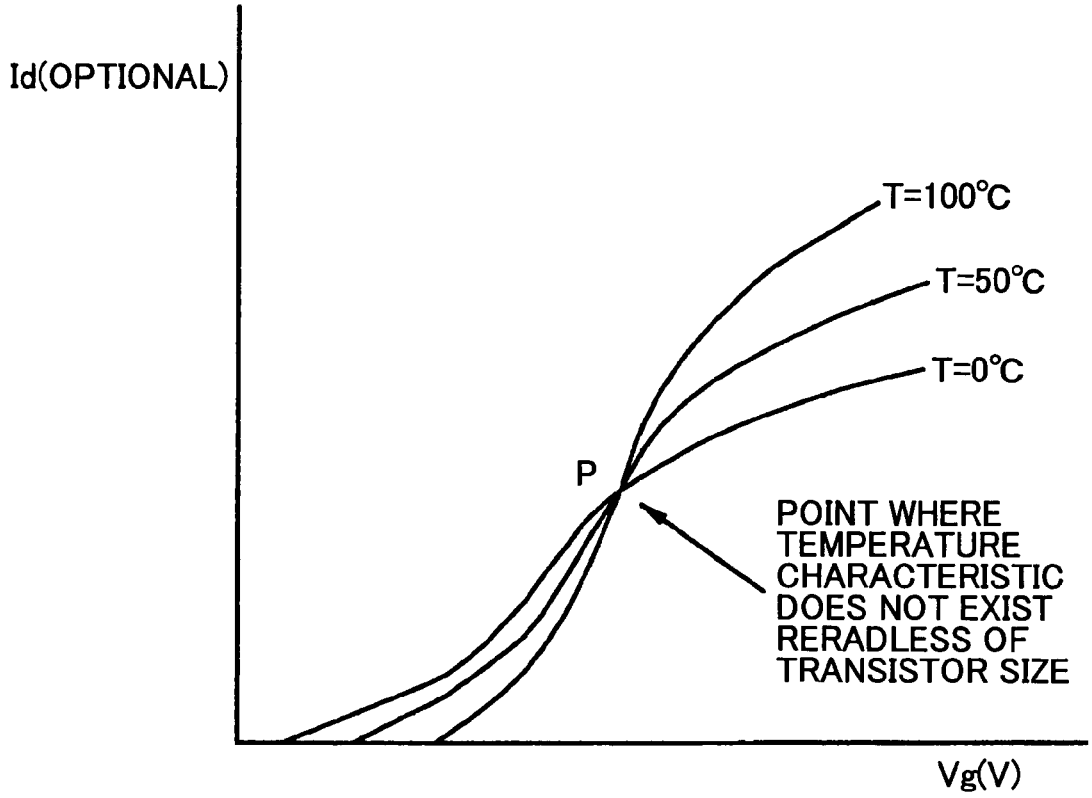
FIG. 5 is a graph showing a temperature characteristic example of a transistor forming the constant current circuit shown in FIG. 4.

FIG. 4 is a circuit diagram showing a structural example of a constant current circuit of an embodiment of the present invention, and FIG. 5 is a graph showing a temperature characteristic example of a transistor forming the constant current circuit shown in FIG. 4.

As shown in FIG. 4, the constant current circuit of the embodiment of the present invention includes a first D-type MOS transistor 1 indicated as DepTr1 in FIG. 4, a second D-type MOS transistor 2 indicated as DepTr2 in FIG. 4, a first E-type MOS transistor 3 indicated as EnhTr1 in FIG. 4, a second E-type MOS transistor 4 indicated as EnhTr2 in FIG. 4, and a third E-type MOS transistor 5 indicated as EnhTr3 in FIG. 4.

Drains of the first and second D-type MOS transistor1 1 and 2 are connected to an electric power supply 6 at a high electric potential side. Sources of the first through third E-type MOS transistors 3 though 5 are connected to a low electric potential side (ground).

A source and a drain of the first D-type MOS transistor (DepTr1) 1 are connected so that a first connection is formed. A gate of the first D-type MOS transistor (DepTr1) 1 and a gate of the first E-type MOS transistor (EnhTr1) 3 are connected so that a second connection is formed. This second connection and the first connection are connected so that a third connection is formed.

A source of the second D-type MOS transistor (DepTr2) 2 and a drain of the second E-type MOS transistor (EnhTr2) 4 are connected via a resistance R1 so that a fourth connection is formed. A gate of the second D-type MOS transistor (DepTr2) 2 and a gate of the second E-type MOS transistor (EnhTr2) 4 are connected so that a fifth connection is formed. This fifth connection and the first connection are connected so that a sixth connection is formed.

A gate of the third E-type MOS transistor (EnhTr2) 5 is connected to the fourth connection between the drain of the second E-type MOS transistor (EnhTr2) 4 and the resistance R1 so that a seventh connection is made.

As a result of this, a drain of the third E-type MOS transistor (EnhTr3) 5 is an output end of a constant current circuit.

Under this structure, in the constant current circuit of the embodiment of the present invention, the first D-type MOS transistor (DepTr1) 1 and the first E-type MOS transistor (EnhTr1) 3 form a voltage reference circuit. The second D-type MOS transistor (DepTr2) 2, the second E-type MOS transistor (EnhTr2) 4, and the resistance R1 form a correction circuit.

A standard voltage 7 generated by the voltage reference circuit formed by the first D-type MOS transistor (DepTr1) 1 and the first E-type MOS transistor (EnhTr1) 3 is applied as a gate voltage of the second D-type MOS transistor (DepTr2) 2 and the second E-type MOS transistor (EnhTr2) 4 forming the correction circuit of a next step.

In the embodiment of the present invention, each of transistor sizes (channel length, gate width, or the like) of the first D-type MOS transistor (DepTr1) 1 and the second D-type MOS transistor (DepTr2) 2 is the same as each of those of the first E-type MOS transistor (EnhTr1) 3 and the second E-type MOS transistor (EnhTr2) 4.

Because of this, operation or performance of the first D-type MOS transistor (DepTr1) 1 and the second D-type MOS transistor (DepTr2) 2 is the same that of the first E-type MOS transistor (EnhTr1) 3 and the second E-type MOS transistor (EnhTr2) 4. A voltage 8 between the source of the second D-type MOS transistor (DepTr2) 2 and the resistance R1 is always the same as the standard voltage 7 generated by the first D-type MOS transistor (DepTr1) 1 and the first E-type MOS transistor (EnhTr1) 3.

In addition, change of a threshold value of voltage of each of the first D-type MOS transistor (DepTr1) 1 and the second D-type MOS transistor (DepTr2) 2 due to unevenness in manufacturing is always in the same direction. An electrical current flowing in each of the circuits is changed by an amount of the change of the threshold value. In this case, a voltage drop corresponding to an amount of the electrical current flowing through the resistance R1 is generated in an output voltage 9 between the resistance 1 and the second E-type MOS transistor (EnhTr2) 4.

In addition, as a change of the threshold value of voltage generated due to unevenness on manufacturing, for example, in a case where the threshold value of the D-type MOS transistor (DepTr) is low (that is, a large amount of electrical current is flowing), the threshold value of the E-type MOS transistor (EnhTr) is low (that is, a large amount of electrical current is flowing). Because of this, the standard voltage 7, 8 being the difference between the threshold value voltages of the D-type MOS transistor and the E-type MOS transistor, is not drastically changed.

In the circuit of the embodiment of the present invention, the D-type MOS transistors 1 and 2 (DepTr 1 and 2) and the E-type MOS transistors 3 through 5 (EnhTr 1 through 3) are made in the same well diffusion by an n channel, so that the threshold value generated due to unevenness in manufacturing is changed in the same direction and the change of the threshold value is cancelled by an amount of drop of the output voltage 9 by the resistance R1. As a result of this, a final electrical current value of the E-type MOS transistor 5 (EnhTr 3) is not drastically changed.

In the related art, there is a problem, as discussed above, that if the MOS transistor performs or operates by using the standard voltage generated by the D-type MOS transistor (DepTr) and the E-type MOS transistor (EnhTr) as a gate voltage and its saturation drain electrical current is used as a constant current source, since the threshold value of the DepTr is changed due to unevenness in manufacturing, the saturation drain electrical current is drastically changed and there is large influence of threshold value unevenness. This problem can be solved by the above-discussed constant current circuit of the embodiment of the present invention.

In the meantime, according to the above-discussed technique, change of the constant electrical current based on change of the threshold value due to unevenness in manufacturing is solved at normal temperature. However, the temperature characteristic, namely change of the threshold value of voltage due to change of temperature of the E-type MOS transistor (EnhTr) generating the constant electrical current cannot be corrected. The technique of the embodiment of the present invention for solving such a problem is discussed with reference to FIG. 5.

The change of the threshold value of the D-type MOS transistor 1, 2 (DepTr 1, 2) shown in FIG. 4 is based on the change of temperature in addition to change due to unevenness in manufacturing.

As shown in FIG. 5, in a Vg-Id characteristic (gate electric potential—drain electrical current) of the transistor, there is a Vg (gate electric potential P) where Id (drain electrical current) is not changed with a change of temperature.

If a resistance not producing the temperature characteristic is used as the resistance R1 in the constant electrical current circuit in FIG. 4, the threshold value of the E-type MOS transistor 5 (EnhTr 3) is set so as to be equal to the gate electric potential P, so that the constant electrical current source having small change in current with a change of temperature can be realized.

In addition, the amount of change of the resistance R1 due to temperature, the change of the threshold value of the E-type MOS transistor 5 (EnhTr 3), and the voltage drop generated by the electrical current value may be made to correct each other.

Furthermore, it is possible to manufacture the constant electrical current source having small change in current with a change of temperature by setting the gate electric potential of the E-type MOS transistor 5 (EnhTr 3) so that change of temperature characteristic of the electrical current between the source and drain of the E-type MOS transistor 5 (EnhTr 3) becomes small.

In the meantime, if the diffusion resistance as the resistance R1 is high, the resistance value is changed by the electric power source voltage 6. Therefore, it is necessary to restrain this influence as much as possible. Accordingly, in the embodiment of the present invention, a poly-silicon resistor is used as the resistance R1. In a case where the poly-silicon resistor is used as the resistance R1 so that the electrical current is wrung out, it is possible to obtain a constant electrical current circuit having small dependency on the electric power source voltage while the resistant value of the resistance R1 should be large.

Thus, as discussed above with reference to FIG. 4 and FIG. 5, in the constant current circuit of the embodiment of the present invention, even if threshold values of the transistors are changed due to manufacturing unevenness so that amounts of electrical current flowing in the transistors are changed, correction is made in a direction where an amount of change is absorbed by the resistance R1 so that a constant value of the electrical current can be maintained. Furthermore, it is possible to maintain a constant electrical current value not depending on a power supply voltage by using a poly-silicon resistor not depending on the power supply voltage for the resistance.

In addition, in the constant current circuit of the embodiment of the present invention, since control is not performed by applying returning by a differential circuit, this constant current circuit has good transient response characteristics.

Thus, according to the above-discussed embodiment of the present invention, it is possible to provide a constant current circuit, including first and second depression type MOS transistors having drains connected to a high electric potential side; and first, second, and third enhanced type MOS transistors having sources connected to a low electric potential side; wherein a source and a drain of the first depression type MOS transistor are connected so that a first connection is formed, a gate of the first depression type MOS transistor and a gate of the first enhancement type MOS transistor are connected so that a second connection is formed; the second connection and the first connection are connected so that a third connection is formed; a source of the second depression type MOS transistor and a drain of the second E-type MOS transistor are connected via a resistance so that a fourth connection is formed; a gate of the second depression type MOS transistor and a gate of the second enhancement type MOS transistor are connected so that a fifth connection is formed; the fifth connection and the first connection are connected so that a sixth connection is formed; a gate of the third enhancement type MOS transistor is connected to the fourth connection between the drain of the second enhanced type MOS transistor and the resistance so that a seventh connection is formed; and a drain of the third enhancement type MOS transistor is an output end of the constant current circuit.

Transistor sizes of the first depression type MOS transistor and the second depression type MOS transistor may be the same as transistor sizes of the first enhancement type MOS transistor and the second enhancement type MOS transistor.

An output voltage on the connection between the resistance and the drain of the second enhancement type MOS transistor of the circuit formed by the second depression type MOS transistor, the second enhancement type MOS transistor, and the resistance is adjusted, and thereby the gate electric potential of the third enhancement type MOS transistor may be set so that temperature characteristic of an electrical current between the source and drain of the third enhancement type MOS transistor is small. The resistance may be a poly-silicon resistance.

The present invention is not limited to these embodiments, but variations and modifications may be made without departing from the scope of the present invention.

This patent application is based on Japanese Priority Patent Application No. 2006-31785 filed on Feb. 9, 2006, the entire contents of which are hereby incorporated by reference.

What is claimed is:

1. A constant current circuit, comprising:

first and second depression type MOS transistors having drains connected to a high electric potential side; and first, second, and third enhancement type MOS transistors having sources connected to a low electric potential side;

wherein a source of the first depression type MOS transistor and a drain of the first enhancement type MOS transistor are connected so that a first connection is formed, a gate of the first depression type MOS transistor and a gate of the first enhancement type MOS transistor are connected so that a second connection is formed;

the second connection and the first connection are connected so that a third connection is formed;

a source of the second depression type MOS transistor and a drain of the second enhancement type MOS transistor are connected via a resistance so that a fourth connection is formed;

a gate of the second depression type MOS transistor and a gate of the second enhancement type MOS transistor are connected so that a fifth connection is formed;

the fifth connection and the first connection are connected so that a sixth connection is formed;

a gate of the third enhancement type MOS transistor is connected to the fourth connection between the drain of the second enhanced type MOS transistor and the resistance so that a seventh connection is formed; and a drain of the third enhancement type MOS transistor is an output end of the constant current circuit.

2. The constant current circuit as claimed in claim 1, wherein transistor sizes of the first depression type MOS transistor and the second depression type MOS transistor are the same as transistor sizes of the first enhancement type MOS transistor and the second enhancement type MOS transistor.

3. The constant current circuit as claimed in claim 1, wherein an output voltage on the connection between the resistance and the drain of the second enhancement type MOS transistor of the circuit formed by the second depression type MOS transistor, the second enhancement type MOS transistor, and the resistance is adjusted, and thereby the gate electric potential of the third enhancement type MOS transistor is set so that temperature characteristic of an electrical current between the source and drain of the third enhancement type MOS transistor is small.

4. The constant current circuit as claimed in claim 2, wherein an output voltage on the connection between the resistance and the drain of the second enhancement type MOS transistor of the circuit formed by the second depression type MOS transistor, the second enhancement type MOS transistor, and the resistance is adjusted, and thereby the gate electric potential of the third enhancement type MOS transistor is set so that temperature characteristic of an electrical current between the source and drain of the third enhancement type MOS transistor is small.

5. The constant current circuit as claimed in claim 1, wherein the resistance is a poly-silicon resistance.

6. The constant current circuit as claimed in claim 2, wherein the resistance is a poly-silicon resistance.

7. The constant current circuit as claimed in claim 3, wherein the resistance is a poly-silicon resistance.

8. The constant current circuit as claimed in claim 4, wherein the resistance is a poly-silicon resistance.

* * * * *